US005884133A

United States Patent [19]

Morimoto et al.

[11] Patent Number: 5,884,133

[45] Date of Patent: Mar. 16, 1999

[54] ELECTROSTATIC IMAGE TRANSFER APPARATUS

[75] Inventors: Toshihide Morimoto, Gose; Masashi Hirai, Katano, both of Japan

[73] Assignee: Sharp Kabushiki Kaisha, Osaka, Japan

[21] Appl. No.: 678,331

[22] Filed: Jul. 11, 1996

[30] Foreign Application Priority Data

Sep. 6, 1995 [JP] Japan ..... 7-229054

[51] Int. Cl.[6] ..... G03G 15/16

[52] U.S. Cl. ..... 399/313; 399/121; 399/314

[58] Field of Search ..... 399/121, 303, 399/304, 310, 313, 314, 315

[56] References Cited

U.S. PATENT DOCUMENTS

| | | | |
|---|---|---|---|
| 5,075,731 | 12/1991 | Kamimura et al. | 355/274 |
| 5,182,602 | 1/1993 | Kakita et al. | 355/271 |
| 5,308,725 | 5/1994 | Yu et al. | 430/56 |
| 5,495,317 | 2/1996 | Matsuda et al. | 355/208 |
| 5,557,384 | 9/1996 | Takano et al. | 355/274 |

FOREIGN PATENT DOCUMENTS

| | | |
|---|---|---|
| 3-186876 | 8/1991 | Japan . |
| 3231273 | 10/1991 | Japan . |
| 4329571 | 11/1992 | Japan . |
| 0063972 | 1/1994 | Japan . |

*Primary Examiner*—Arthur T. Grimley
*Assistant Examiner*—Quana Grainger

[57] ABSTRACT

An image transfer device includes: first and second rollers; and exit-side roller disposed downstream of the second roller; an endless transfer belt tensioned between the first roller and the exit-side roller with the second roller in between so that the part of the transfer belt between the first and second rollers can be kept in contact with a photoreceptor; a conductive, endless voltage supplying belt tensioned between the first and second rollers so as to come in contact with a wide area of the inside surface of the transfer belt. The first roller is applied with a predetermined voltage from a power source so that the voltage is supplied to the transfer range of the transfer belt via the voltage supplying belt. In this arrangement, when a sheet of paper is conveyed into the contact area between the transfer belt and the photoreceptor, a toner image formed on the photoreceptor is transferred to the fed sheet of paper.

5 Claims, 7 Drawing Sheets

ELECTROSTATIC IMAGE TRANSFER APPARATUS

BACKGROUND OF THE INVENTION (1) Field of the Invention

The present invention relates to an image transfer device for use in an image forming apparatus, particularly relating to an image transfer device in which an image formed on the recording medium is electrostatically transferred to a sheet of paper.

(2) Description of the Prior Art

In the image forming apparatus using electrophotography, a photoreceptor which is made up of a conductive substrate (drum) coated with a photoconductive layer as a recording medium, is exposed to an optical image so that an electrostatic latent image is formed in accordance with this image. In order to visualize the latent image, toner as a coloring pigment is adhered thereto. The thus developed toner image is then electrostatically transferred to a transfer sheet which is fed in synchronism. Subsequently, the sheet is passed through the fusing fixing unit and discharged from the image forming apparatus body.

As a device for transferring the toner image formed on the photoreceptor, corona-chargers have been widely used, which supply opposite polarity to that of the static charge of the toner, to the undersurface of the paper sheet being conveyed, so that the toner image is electrostatically transferred to the paper sheet. Alternatively, in place of the corona charger, a device having a transfer roller which presses the paper sheet against the photoreceptor can be used. In this contact stage, the transfer roller is applied with a voltage opposite to the polarity of the toner, so that the toner is electrostatically transferred onto the paper sheet.

In stead of transferring the toner image formed on the photoreceptor as stated above, in some cases, the static latent image may be transferred by bringing a paper sheet, whose surface is treated with an insulator such as a dielectric layer etc., into intimate contact with the photoreceptor using a transfer roller etc. By this configuration, there is no longer a need to clean the photoreceptor of leftover toner after the toner image has thereon been transferred.

In contrast to those using the conventional corona charger or the transfer roller, it has been disclosed in Japanese Patent Application Laid-Open Hei 3 No. 231,273 that a transfer belt should be provided in order to convey the sheet which has had toner transferred, at the same time as transferring the toner image thereto. This transfer belt is tensioned between a pair of rollers; one of the rollers is abutted against the photoreceptor with the transfer belt inbetween and is supplied with a voltage for the transfer operation. FIG. 1 shows a typical example of it.

As shown in FIG. 1, a paper sheet P is fed inbetween a photoreceptor 10 and a transfer belt 11. One roller 12 which stretches the transfer belt 11 is applied with a voltage from a power source 14 so that an electric field is generated. This electric field causes the toner image formed on the photoreceptor 10 to electrostatically transfer to the paper sheet P side. The above transfer belt 11 is driven in synchronism with the rotation of the photoreceptor, by means of the driving roller 12.

In this way, in accordance with the transfer device shown in FIG. 1, roller 12, or one of the rollers for driving the transfer belt 11, is applied with a voltage for the transfer operation so that the toner image is transferred to the paper sheet P. Therefore, the paper sheet P after the toner has been transferred thereto is conveyed along the surface of the driven belt 11, to the next stage where the fixing operation is to be made. That is, the transfer device can also be used as the conveying device thus making it possible to make the apparatus compact.

Nevertheless, since in the transfer position of transfer belt 11, the photoreceptor 10 and roller 12 contact with one another in their arc portions, the contact range is narrow. That is, the contact range between the photoreceptor 10 and the transfer belt 11, which will form the transfer area, is extremely narrow so that the contact portion between the paper sheet P and the photoreceptor 10 becomes small. Hence, if the speed of the image formed in the image forming apparatus is raised, the passage time of the paper through the transfer position is shortened due to the shortness of the contacting time. This means that the necessary amount of charge cannot be imparted to the paper sheet to achieve an adequate transfer operation, thus causing transfer failure etc.

In order to eliminate the above problem, if the voltage to be applied to the roller 12 is increased, the transfer efficiency may be improved so that the transfer defect can be inhibited. The application of the high voltage, however, causes a large variation in the amount of charge to be imparted to the paper sheet P due to resistance fluctuation of the transfer belt 11. This variation directly affects as the dispersion of the transfer efficiency. This means that, when the toner image of 'solid black' is transferred to the paper sheet, a pattern with various uneven spotted densities is transferred as it is, resulting in failures to produce a transferred image with even density. Thus, a measure against transfer failures could, on the contrary, promote the transfer failures.

The above problem of transfer failures can be eliminated if the resistance value of the transfer belt is set uniformly throughout the entire area thereof. However, it is very difficult to make the resistance value of the transfer belt uniform, and if it is done in manufacturing, the cost can become very high.

SUMMARY OF THE INVENTION

In view of the above problems, it is an object of the present invention to broaden the contact range between the photoreceptor as a recording medium and the transfer belt so as to stabilize the amount of charges to be imparted to the paper sheet and thereby improve the reliability of the transfer operation.

It is another object of the invention to downsize the image forming apparatus. For this purpose, a means for conveying a sheet which has had toner transferred thereto, is constructed by taking advantage of the static attraction of the sheet to the transfer belt.

It is still another object of the invention to easily separate the sheet from the transfer belt when the sheet is conveyed to the next stage. For this purpose, the static attraction of the sheet to the transfer belt is inhibited by limiting the application of the transfer voltage within a part of the transfer belt.

In order to achieve the above object, the present invention includes the following aspects:

The first aspect of the invention resides in that an image transfer device comprises: a plurality of rollers; an endless transfer belt tensioned between the rollers so as to be abutted against a recording medium forming a transfer portion, so that an image formed on the recording medium is transferred to a sheet of paper in the transfer portion; and an endless voltage supplying belt made from a conductive material, and tensioned inside the transfer belt, between the rollers in the same manner as the transfer belt, wherein the rollers are appropriately positioned so that the tensioned transfer belt can be kept in contact with the recording medium, and a predetermined voltage is supplied to the voltage supplying belt.

In accordance with the above structure, it is possible to acquire a wide contact range between the transfer belt and the photoreceptor as the recording medium, so that the transfer area can be broadened and therefore the transfer efficiency can be improved.

The second aspect of the invention resides in that, in the image transfer device having the above first aspect, the voltage supplying belt is made from a high-resistance material, and the predetermined voltage is applied via each of the rollers between which the voltage supplying belt is tensioned. By this method, it is possible to make substantially uniform, the voltage of the transfer belt, in particular, within the transfer area.

The third aspect of the invention resides in that, in the image transfer device having the above first aspect, the voltage supplying belt is arranged so as to come in close contact with the entire part of the inside surface of the transfer belt, and a separating claw or claws are disposed opposite to one of the rollers which is positioned on the exit side with respect to the sheet conveying direction. In this structure, since the voltage supplying belt is made in contact with the entire part of the transfer belt, it is possible to retain the close contact between the sheet and the transfer belt even in the portion away from the transfer area. As a result, the sheet, after the completion of the transfer operation, can be conveyed successfully.

The fourth aspect of the invention resides in that an image transfer device comprises: a pair of first and second rollers, the second roller being disposed downstream of the first roller with respect to the sheet conveying direction; an endless voltage supplying belt made from a conductive material, and tensioned between the first and second rollers; an exit-side roller which is positioned downstream of the second roller; and an endless transfer belt tensioned between the first roller and the exit-side roller so that the sheet to be processed may be introduced to the next stage, wherein the first and second rollers are appropriately positioned so that the part of the transfer belt between the first and second rollers can be kept in contact with a recording medium, and a predetermined voltage is supplied to the voltage supplying belt via the first and second rollers.

By this method, it is possible to acquire a wide range of the transfer area, while it is possible to make the transfer belt also serve as the conveying means which separates the sheet after the completion of the transfer operation, from the recording medium and delivers it to the next stage.

The fifth aspect of the invention resides in that, in the image transfer device having the above fourth aspect, a charge erasing electrode plate which is grounded is abutted against a part of the transfer belt between the second roller and the exit-side roller. In this structure, since the grounded charge erasing electrode plate is brought in contact with the part of the transfer belt between the aforementioned rollers, it is possible to release the static charge from the transfer belt to the ground so that the attracting force of the sheet which has electrostatically been adhered to the transfer belt, to the transfer belt can be weakened. In this way, the sheet can readily be separated from the transfer belt.

The sixth aspect of the invention resides in that, in the image transfer device having the above fourth aspect, a plurality of exit-side rollers are provided in place of one exit-side roller, and an endless conductive belt which is grounded is tensioned between the exit-side rollers so as to come in contact with the part of the inside surface of the transfer belt between the exit-side rollers. By this arrangement, it is possible to enhance the action of weakening the statically attracting force between the transfer belt and the sheet.

The seven aspect of the invention resides in that, in the image transfer device having the above fourth aspect, the conductive belt as the voltage supplying belt is laid out by a plurality of exit-side rollers, in place of one exit-roller, in such a winding manner that the conductive voltage supplying belt will not be in contact with the transfer belt, at least in the separating region in the vicinity of the exit-side rollers, and a sheet-separating claw or claws are arranged opposite to the exit-roller which is closest to the exit side with respect to the sheet conveying direction. By this arrangement, since the transfer belt will not attract the paper sheet more during the separation of the sheet than that in the case of the image transfer device of the sixth aspect, it is possible to reduce the separating force exerted by the separating claws. As a result, there is no fear that the sheet itself would be damaged by the claws during the separation of the paper sheet, whereby it is possible to readily separate the paper sheet.

DESCRIPTION OF THE PREFERRED EMBODIMENTS

Figure 1:
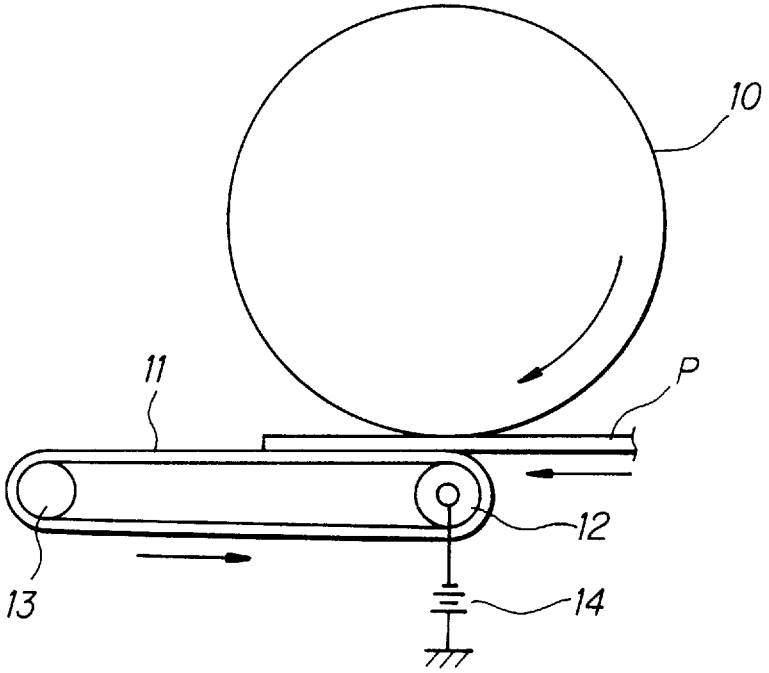
FIG. 1 PRIOR ART
FIG. 1 is a front view showing an overall configuration of a conventional transfer device.

The embodiments of the present invention will hereinbelow be described with reference to FIG. 2, which in particular, shows the transfer position for images in an image forming apparatus.

In the figure, a photoreceptor 1 as a recording medium is made up of a cylindrical drum of, for instance, aluminum etc. with a photoconductive layer formed on the surface of it. The drum surface may have a protecting layer made of a transparent insulative material etc., over the photoconductive layer.

The photoreceptor 1 is rotated clockwise in the figure at a predetermined rate, having been instructed to start the image forming operation. At a site around the periphery of the drum, a charging means (not shown) is provided to electrify the photoreceptor surface at a uniform level of a specified polarity. Disposed downstream of the charger is an optical means which illuminates the drum with the optical image in accordance with the original image. As the optical image is irradiated on the drum by the optical means, an electrostatic latent image, in accordance with the image is formed on the photoreceptor surface.

In order to visualize the static latent image formed on the photoreceptor 1, a developing unit is provided for the next stage. In the developing unit, toner particles are electrified to carry a specified polarity so that the charged toner can adhere to the surface of the photoreceptor 1. The toner image 2 formed in the developing unit is then conveyed to the point where a transfer unit 3 is, where the image 2 is transferred to the paper sheet P which has been delivered in synchronism.

After the transfer operation, part of toner which has not been transferred, is left over on the surface of the photoreceptor 1. In order to remove the leftover toner, a cleaning unit is provided. Further, a charge erasing unit is provided in order to eliminate residual charges on the photoreceptor after or before the cleaning operation and to prepare for the next image forming operation.

In this way, the image forming assembly is configured in the image forming apparatus. The toner image on the paper sheet after transfer is not fixed, therefore the sheet is passed through the well-known heat fixing unit whereby the unfixed toner is fused and fixed onto the sheet. After the fixing, the paper sheet P carrying the toner image formed on the surface thereof is discharged to the outside of the image forming apparatus.

The purpose of transfer unit 3 in the present invention is to electrostatically transfer the toner image formed on the photoreceptor 1, to the paper sheet P and the embodied modes of it will be described hereinbelow.

(First embodiment)

The transfer unit 3 includes, as shown in the figure, a transfer belt 30 which abuts the surface of the photoreceptor 1 and a voltage supplying belt 31 disposed inside the transfer belt in order to supply a transfer voltage to the transfer belt 30 whereby the toner image 2 is transferred to the paper sheet P which is being conveyed. Particularly, the voltage supplying belt 31 is an endless conductive belt made from a metal with a low volume-resistivity and is tensely stretched between a driven roller 32 as the first roller and a driving roller 33 as the second roller.

The transfer belt 30 is also an endless belt made up of, for instance, polyimide, rubber containing carbon or any other material having a very high volume-resistivity. This transfer belt 30 is stretched between a driven roller 34 as the exit-side roller and the aforementioned driven roller 32 with the driving roller 33 in between. In order to tension the voltage supplying belt 31 and the transfer belt 30, the driven roller 32 (the first roller) is made movable in the right-and-left direction in the figure or in the direction of conveying the paper sheet P and is urged by an urging force of a spring etc. in the direction to increase its distance from the driving roller 33 (the second roller). In this way, both the belts 30 and 31 are stretched with appropriate tensions between the driven 32, and the driving roller 33 or driven roller 34.

It is also possible that the driven roller 34 (the exit-side roller) is provided movable in the same manner as the driven roller 32 (the first roller) does, and a spring etc. which exerts an urging force on the driver roller 34 in the direction to increase its distance from the driving roller 33 (the second roller), may be provided to impart an appropriate tension. In this case, since the transfer belt 30 is tensioned between the common driven roller 32 which also supports the voltage supplying belt 31, and the driven roller 34 (the exit-side roller), the belt 30 might become unstable if the both the rollers 32 and 34 move. For this reason, the best structure is one where the driven roller 32 which at least supports both the belts 30 and 31 is provided movable in order to impart a tension to the belts 30 and 31.

On the other hand, in order to establish a large contact area between the transfer belt 30 and the photoreceptor 1 with a transfer sheet P in between, both the first and second rollers 32 and 33 are arranged so that the portion between the driven roller 32 (first roller) and the driving roller 33 (second roller) can be kept in contact with the photoreceptor 1. In order to drive the two belts 30 and 31 as well as to create an intimate contact with the photoreceptor 1, the diameter of the driving roller 33 is formed larger than the those of the driven rollers 32 and 34 so that the voltage supplying belt 31 may be closely placed about the driving roller 33.

In this arrangement, when the driving roller 33 rotates, the voltage supplying belt 31 is rotated or made to run in accordance with this driving. At the same time, the transfer belt 30 between the driving roller 33 and the driven roller 32 has been tensioned to come in close contact with the voltage supplying belt 31, and the diameter of the driving roller 33 is adequately set greater so that the transfer belt 30 can rotate without slipping.

By the above driving system, there is no longer a need to provide individual driving systems for the voltage supplying belt 31 and transfer belt 30, separately. Further, the two belts 30 and 31 can be driven in the same speed. This means that the configuration can remarkably be simplified. The transfer belt 30 is driven at the same speed as the peripheral speed of the cylindrical surface of the rotating photoreceptor 1.

The transfer belt 30 should cause toner image 2 to transfer to the paper sheet P as it is being conveyed. In order to achieve this, the voltage to be required for transferring is supplied to the driven roller 32 from a power source 4. The voltage is set at about −2 KV, for example. In this case, the surface of the photoreceptor 1 is charged by the charging means at a potential of −800 V, for example.

Whilst the paper sheet which has had toner transferred thereto is being placed on the transfer belt 30, the driven roller 34 (the exit-side roller) conveys the belt together with the paper. In order to allow the paper sheet forward into the heat fixing unit (not shown) as well as to enable the paper sheet to easily be separated from the transfer belt 30, the driven roller 34 is grounded. Further, the driven roller 34 is disposed as the exit-side roller along the conveyance path of the paper sheet P at a point close to the unillustrated fixing unit. That is, the transfer belt 30 is stretched about the driven roller 34 (exit-side roller), so that the belt will also serve as the transferring means.

Figure 3:
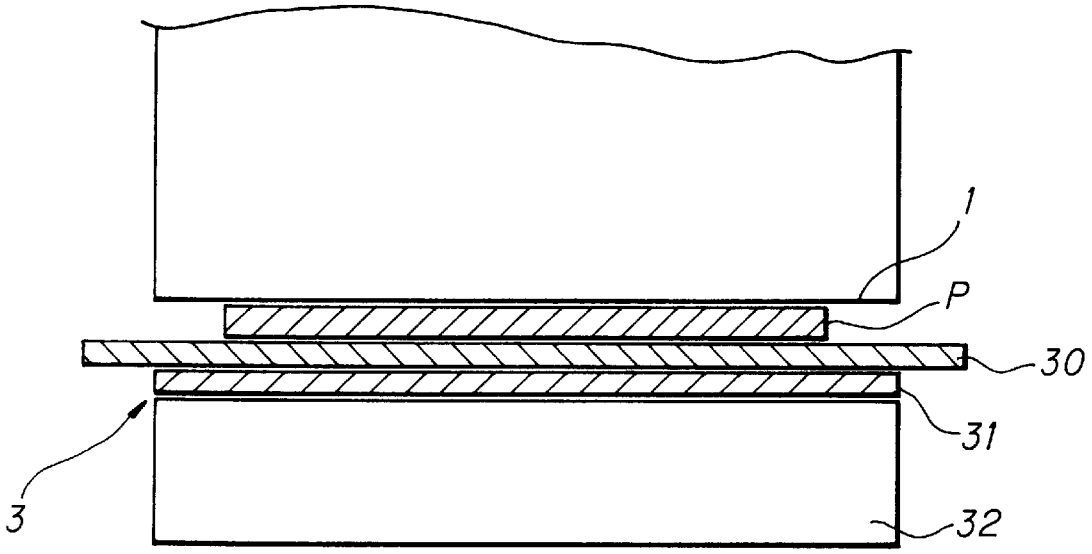
FIG. 3 is a sectional view showing the transfer device of FIG. 2, cut by a plane perpendicular to the conveying direction of the paper sheet.

Since a high voltage is provided to the voltage supplying belt 31 via the driven roller 32 as stated above, the width of the transfer belt 30 is made greater (in the axial direction of the driven roller) as shown in FIG. 3. The paper sheet P shown in this figure represents the width of a maximum size of paper to be handled in the image forming and this width corresponds to the effective image area of the photoreceptor 1. The width of the transfer belt 30 is set sufficiently wider compared to that of the photoreceptor 1 to prevent current leakage from the voltage supplying belt 31 to the drum of the photoreceptor 1 made from aluminum etc. The width of the driven roller 32 is at least equal to that of the photoreceptor 1, and is not set so wide as to project out beyond the width of the voltage supplying belt 31. Particularly, the voltage supplying belt 31 is set with a size which allows the voltage to be supplied to the area which corresponds to the entire part of the paper sheet P.

Figure 4:
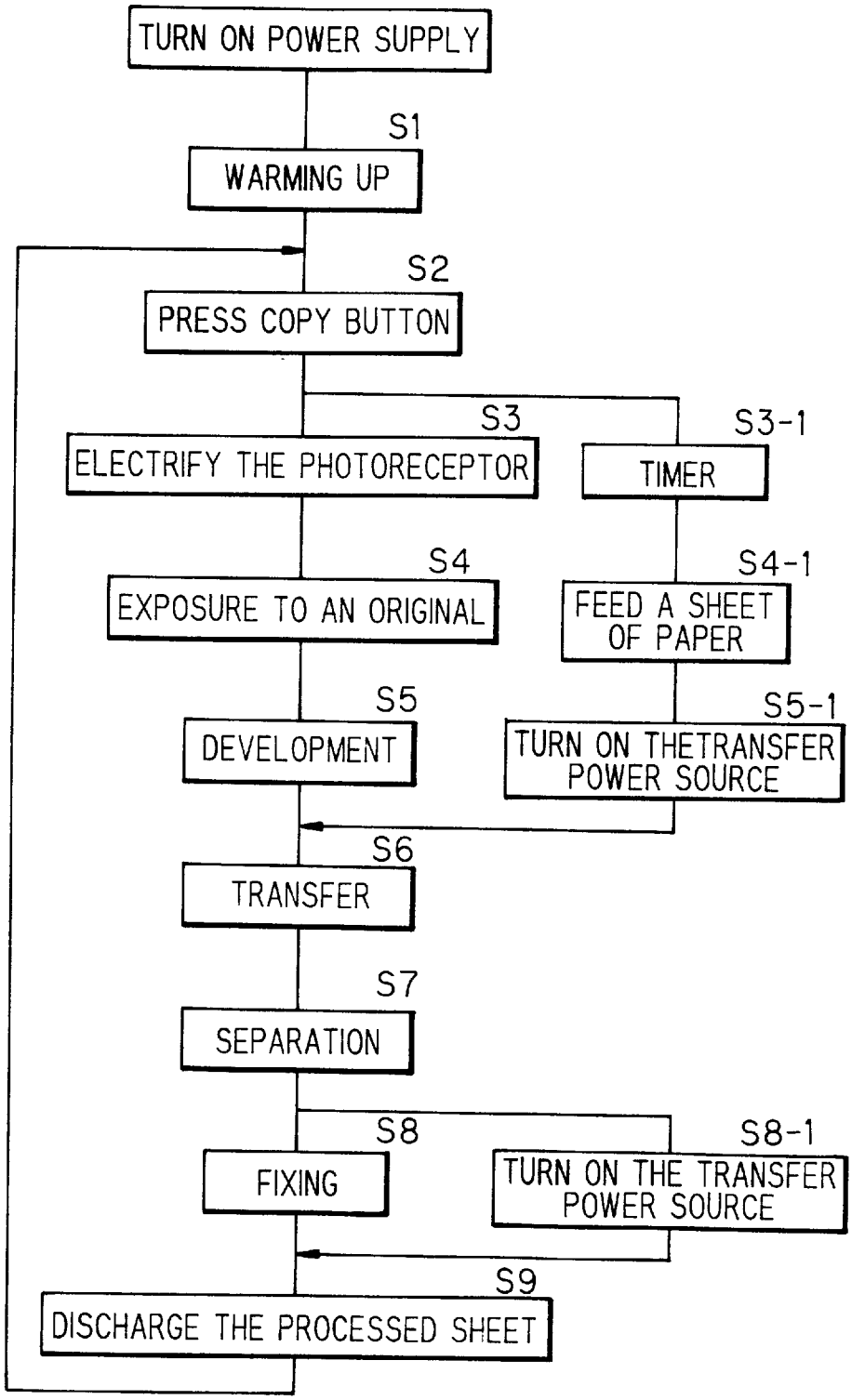
FIG. 4 is a flowchart showing the operation of image forming and the transfer operation of the transfer device of the invention.

In the image forming apparatus thus configurated, as the image forming is commenced, the image forming operation is performed following the flowchart shown in FIG. 4 and the transfer device of the invention operates its function.

First, when the power switch of the image forming apparatus is turned on, the apparatus is initialized and a warm-up procedure is started (Step S1). This step includes: cleaning of the surface of the photoreceptor 1, the initialization of the surface potential of it, agitation of the developer in the developing unit, temperature adjustment of the heat fixing unit, and other preparations and adjustments of various parts constituting the image forming system. When these actions have been completed and the temperature of the heat fixing unit has reached a specified temperature under controlled conditions, a 'ready lamp' illuminates and the apparatus becomes ready for copying.

In the case where the image copying apparatus is a copier, a document is set and various copying conditions such as the number of copies, magnification, density level etc., are inputted. Then as the 'copy button' is operated (S2), the copying operation is performed.

Then, the charger is operated whilst the photoreceptor 1 is being rotated, so that the surface of the photoreceptor 1 is successively charged uniformly at a level of about −800 V, for example (S3). Next, the photoreceptor 1 is exposed to the reflected image which is projected from the original by way of the optical means (S4). During the exposure, electric charges on areas on the photoreceptor 1 which correspond to the light parts of the original image, flow to the ground (or earth), whereas charges on areas which correspond to the dark parts of the original image remain as they are on the surface. In this way, an electrostatic latent image will be created in conformity with the image of the original. As the photoreceptor 1 rotates further and the latent image reaches the developing unit, toner particles electrified at about +300 V, for example, electrostatically adhere to the charged areas (which correspond to the dark portions in the original image) on the photoreceptor surface so that the latent image will be developed (S5). The image thus developed is referred to as the toner image 2.

On the other hand, when the image forming is started, a paper sheet P is fed from the sheet feeding portion in synchronism with the rotation of the photoreceptor 1 so that the sheet P is conveyed by an unillustrated conveying roller (resist roller) to the transfer portion at the point when the front edge of the toner image formed in conformity with the original image on the photoreceptor 1 reaches the same position. Since this timing has been known previously, the start time of the conveying roller is controlled using a timer (S3-1) and the conveyance of the paper sheet P to the transfer portion is started (S4-1). Then, in order to supply the voltage for the transfer operation from the power source 4 to the driven roller 32 (S5-1) right before the front edge of the paper sheet P reaches the transfer portion, a control switch (not shown) is turned on. Thus, a high voltage of about −2 KV is supplied to the driven roller 32.

Meanwhile, the transfer belt 30 and the voltage supplying belt 31 have been driven at an identical speed in conformity with the rotation of the photoreceptor 1, before the voltage is supplied as above. Then, the predetermined voltage as stated above is supplied from the power source 4 right before the paper sheet P is fed.

Subsequently, when the paper sheet P is fed into the transfer portion where the photoreceptor 1 and the transfer belt abut one another, toner particles charged at about +300 V are attracted toward the paper sheet P side from the surface of the photoreceptor 1 electrified at about −800 V by the transfer belt 30 which is charged at about −1000 V. That is, the paper sheet P is charged at a potential of about −1000 V via the transfer belt 30, so that the toner particles of the toner image 2 will electrostatically be transferred to the paper sheet P side. In this way, the toner image 2 can be transferred (S6).

Since the paper sheet P is electrostatically attracted more to the transfer belt 30 than by the photoreceptor 1, the sheet, whilst being statically attracted to and conveyed by the transfer belt 30, is brought into contact with the photoreceptor 1 in the transfer portion. After the transfer portion, the sheet is still statically attracted to and conveyed by the transfer belt 30 so that the sheet may be separated from the photoreceptor 1. Since the driven roller 34 which is disposed on the exit-side in such a position that it is opposite to the heat fixing unit, is connected to the ground, charges on the paper sheet P as well as on the transfer belt 30 are eliminated at that position. In this way, the paper sheet P can readily be separated from the transfer belt 30 (S7). Particularly, if the curvature of the driven roller is made large, the paper sheet P will be more easily separated by virtue of the rigidity of the paper sheet P.

The paper sheet P which has been separated from the transfer belt 30 is fed to the heat fixing unit where the toner is fused and fixed (S8). After the completion of the fixing operation, the sheet is conveyed further so that it is discharged from the image forming apparatus (S9) to complete the copying operation. In the course of the operation, when the transfer operation of toner to the paper sheet P by the transfer belt 30 is complete during the fixing of the toner image to the paper sheet P, the application of the voltage from the power source 4 is cut off (S8-1). Particularly, as soon as the trailing edge of the paper sheet P has passed over the transfer area, the application of the voltage is cut off.

In this way, the paper sheet P is fed along the unillustrated paper guide by means of the conveying roller to the transfer portion where the photoreceptor 1 and the transfer belt 30 abut one another whilst the transfer voltage is applied to the driven roller 32 in harmony with the fed sheet. The supplied voltage to the roller 32 is transmitted to the voltage supplying belt 31 as a conductive belt which in turn generates a transfer electric field around the portion of the transfer belt 30 in contact with the voltage supplying belt 31. Thus, the toner image 2 formed on the photoreceptor 1 is transferred to the paper sheet P to achieve the transfer operation.

In particular, the voltage supplied to the driven roller 32 generates an induced voltage on the surface of the transfer belt 30. In this case, as stated above, if a voltage of about −2 KV is supplied to the driven roller 32 from the power source 4, this voltage is transmitted to the voltage supplying belt 31, which, by virtue of the induction effect, generates a voltage of about −1000 V on the surface of the transfer belt 30. The potential thus generated on the transfer belt 30 is higher than the surface potential of the photoreceptor 1 which is electrified at a voltage of about −800 V. Therefore, the paper sheet P, without forming electrostatic contact with the photoreceptor 1, remains electrostatically adhered to the transfer belt 30 which is charged at the higher potential, so that the sheet can be separated from the photoreceptor 1.

The paper sheet P, while being statically attracted to the transfer belt 30, is further conveyed to the position where the driven roller 34 on the exit side is. The driven roller 34 is connected to the ground in order to erase electricity on the transfer belt 30, charges on the paper sheet P as well as the transfer belt 30 flow to the ground side whereby the potential lowers. In this way, the electrostatic attraction between the paper sheet P and the transfer belt 30 is weakened. Therefore, the paper sheet P goes forward keeping its flat position by virtue of its own rigidity while the transfer belt 30 goes on turning in the reverse direction along the circumferential side of the driven roller 34. That is, the sheet P is readily separated from the transfer belt 30 by virtue of the sheet's rigidity and is conveyed to the next stage where the fixing unit is.

Here, the voltage from the power source 4 is supplied to the driven roller 32. Accordingly, the whole part of the voltage supplying belt 31, which is conductive, will be electrified at the same potential and therefore the voltage will be supplied to the area of the transfer belt 30 which is in close contact with the belt 31. In particular, when the voltage is applied to the conductive voltage supplying belt 31 and if the voltage is also made to be applied to the driven roller 32 as stated above, the same voltage will be supplied to the transfer belt 30 in the transfer area between the photoreceptor 1 and the transfer belt 30 which is in contact with the photoreceptor 1. Accordingly, a greater voltage than the surface potential of the photoreceptor 1 is generated in the transfer belt 30 by virtue of the electrostatic induction. Thus, the toner image can be transferred to the paper sheet P while it is still attracted to the belt 30.

Figure 2:
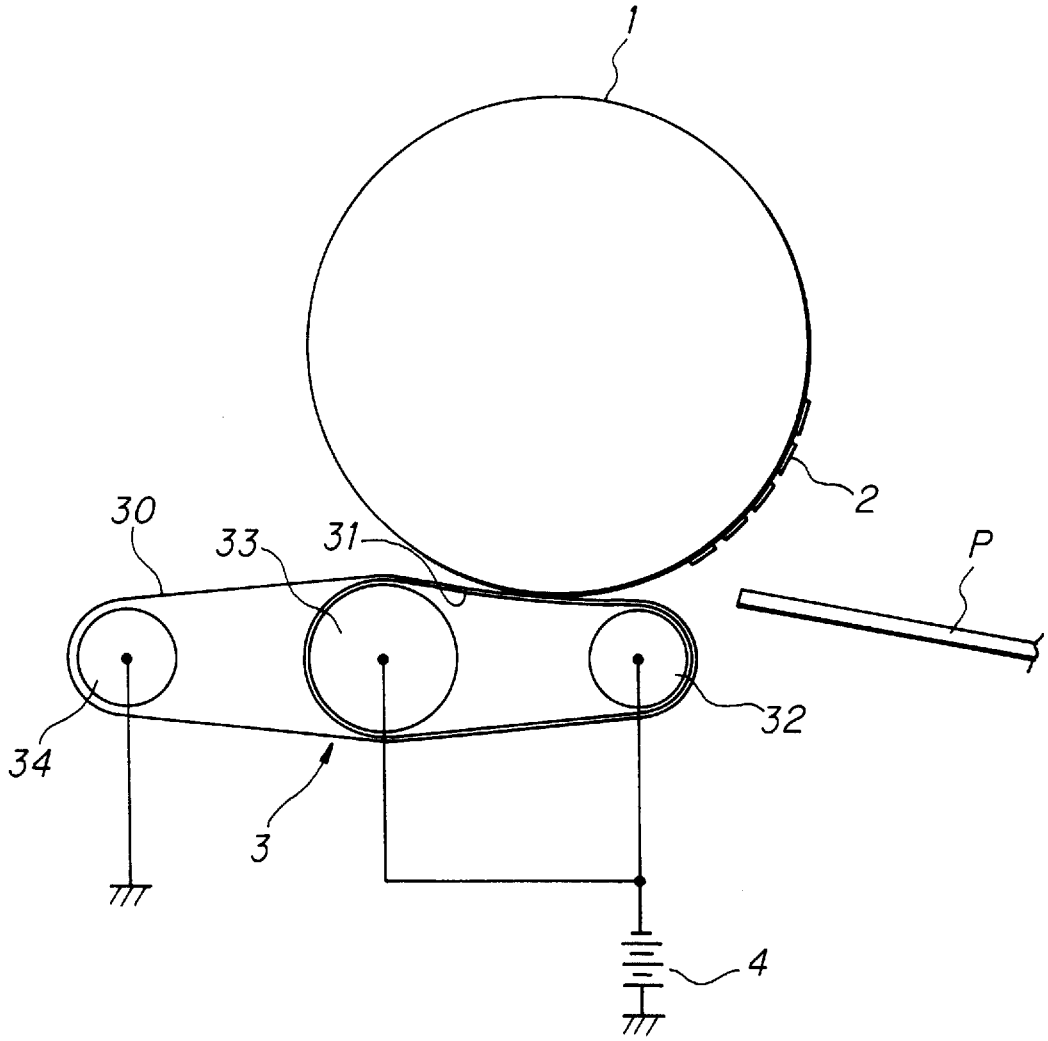
FIG. 2 is a front view showing an example of a transfer device for illustrating the first embodiment of the invention.

In contrast, as shown in FIG. 2, when the same voltage as that of the driven roller 32 is applied from the power source 4 to the driving roller 33, the above effect is promoted further. Moreover, when the voltage supplying belt 31 is made up of the same material as that of the transfer belt 30, there is an advantage that problems due to leakage etc., can be eliminated. In this case, however, the application of the voltage from the power source 4 to the driven roller 32 can not manage to supply the desired voltage to the transfer area where the transfer belt 30 is in contact with the photoreceptor 1.

This is because the resistivity of the voltage supplying belt 31 is markedly high. That is, the voltage supplied to the belt gradually lowers from the closest side to the driven roller 32 toward the far side due to resistance. When the paper sheet P is within the initial part of the transfer area between the photoreceptor 1 and the transfer belt 30, the voltage supplied is high. This means that the attraction between the paper sheet P and the transfer belt 30 becomes very strong. However, as the paper sheet P is conveyed gradually through the transfer area and approaches the exit side of the transfer area (the position where the contact between the transfer belt 30 and the photoreceptor 1 terminates), the paper sheet P will statically be attracted toward the photoreceptor 1 because the voltage supplied to the area of the transfer belt 30 lowers. Accordingly, the sheet cannot be conveyed with the running transfer belt 30, but is conveyed in contact with the photoreceptor 1.

Further, since the voltage to be supplied to the transfer belt 30 falls gradually as it goes through the transfer area, the transfer efficiency lowers, thus making it impossible to attain sufficient transfer of the toner image to the paper sheet P.

In order to prevent the above problem, the voltage should be supplied not only to the driven roller 32 but also to the driving roller 33 as shown in FIG. 2. By this arrangement, it is possible to supply the equivalent voltage to the exit region of the transfer belt 30, as is applied to the entrance region of the transfer area. Accordingly, it is possible to convey the paper sheet P so it passes through the transfer area whilst also being attracted to the transfer belt 30.

In particular, when the voltage supplying belt 31 is formed of the same or similar high-resistance material as used for the transfer belt 30, the apparent resistance in the transfer area where the transfer belt 30 is in close contact with the voltage supplying belt 31, will be reduced since the total thickness of the transfer area is increased because of the two belts. Further, since the same voltage is supplied to both the driven roller 32 and the driving roller 33, the voltage at any point on the transfer belt lowers as the point will become distant from either rollers 32 or 33. That is, there occurs a voltage gradient over the belt surface. Nevertheless, because the resistance is smaller the voltage gradient in the two-belt configuration, is less than when only the transfer belt 30 was used to supply the voltage instead of the voltage supplying belt 31. Further, since the two rollers 32 and 33 are supplied with a voltage, the voltage gradient in the transfer area in which the transfer belt 30 abuts the photoreceptor 1 is small. Therefore, the voltage to be supplied to the transfer belt 30 becomes close to the supplied voltage. Thus, the potential generated on the contact area surface between the transfer belt 30 and the photoreceptor 1 is made substantially uniform throughout all of the contact area. As a result, it is possible to efficiently transfer the toner image to the paper sheet P, and at the same time, it is possible to make the paper sheet P pass through the transfer area whilst the paper is being attracted to the transfer belt 30.

In this way, in accordance with the transfer device 3 of the above embodiment, the transfer area can be established large enough, whereby it is possible to ensure a sufficiently long time to transfer the toner image. As a result, when the speed of images formed is enhanced, it is possible to achieve stable transfer operations without needing to set a higher voltage to be supplied to the transfer belt 30. Further, since the transfer belt 30 can be used for two purposes, that is, to separate the paper sheet P after transfer from the photoreceptor and to convey the paper sheet P, the configuration lends itself to making the apparatus compact.

(Second embodiment)

In the above-described transfer device 3 of the invention, the following mode of the embodiment is to enhance the effect of separating (peeling) the paper sheet P after transfer, from the transfer belt 30 to which the sheet is attracted. As stated in the above description, the paper sheet P is conveyed whilst being sandwiched between the transfer belt 30 and the photoreceptor 1 in the transfer area. During this period, the toner image 2 will be statically transferred to the paper sheet P. Then the paper sheet P statically comes in close contact with the transfer belt 30. If the sheet, whilst in close contact, passes by the transfer area, the paper sheet P will be conveyed in the direction of rotation (transportation) of the transfer belt 30.

In accordance with the first embodiment, the exit-side roller (driven roller) 34 of the rollers which tensions the transfer belt 30, is connected to the ground. This connection enables elimination or erasure of electricity charged on the transfer belt 30, whereby the static attraction between the transfer belt 30 and the paper sheet P is weakened and therefore the paper sheet P is separated from the transfer belt 30 due to its own rigidity.

Nevertheless, the erasure of electricity charged on the transfer belt 30 could not be well performed in some parts of the driven roller 34, especially in the exit-side separating position. In such a case, any residual charge may attract the paper sheet P onto the transfer belt 30. Therefore, the embodiment of effectively eliminating the electrostatically attracting force will be described hereinbelow.

Figure 5:
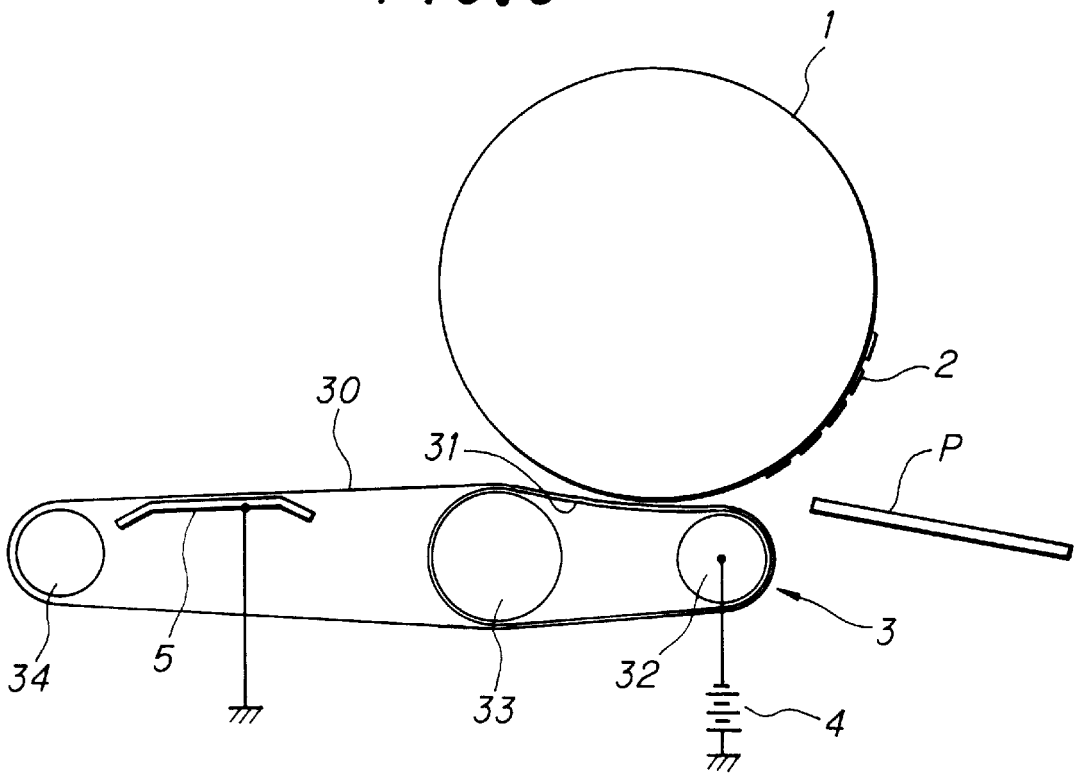
FIG. 5 is a front view showing an example of a transfer device for illustrating the second embodiment of the invention.

Shown in FIG. 5 is a charge erasing electrode plate 5 which is in contact with the undersurface of the transfer belt 30. This charge erasing electrode plate 5 is made from a conductive material such as a metal plate etc., and is connected to the ground.

The charge erasing electrode plate 5, as shown in the figure, is positioned away from the transfer area or between the driving roller 33 and the driven roller (exit-side roller) 34 and is placed in contact with a considerable amount of the length of the transfer belt in the conveyance direction of the paper sheet P, along the inside surface of the transfer belt 30 which is opposite to the surface that attracts the paper sheet P. This arrangement allows electricity charged on the transfer belt 30 to escape to the ground. In this way, the charge on the belt 30 can be removed.

In the above configuration, when a part of the transfer belt 30 which has passed by the transfer area, reaches the charging erasing electrode plate 5 which is grounded, the static charge retained on the paper sheet P flows through the part of the transfer belt 30 and the charge erasing electrode plate 5, while the potential of the transfer belt 30 reduces in conformity with the potential of the charge erasing electrode plate 5.

Accordingly, both the potentials of the paper sheet P and the transfer belt 30 lower and therefore, the statically attracting force therebetween becomes weakened. The paper sheet P is further conveyed while it is being statically attracted to the transfer belt 30, and then reaches the driven roller (exit-side roller) 34. At that point, the transfer belt 30 turns in the reverse direction along the circumferential side of the driven roller 34, while the paper sheet P is readily separated from the transfer belt 30 by virtue of its own rigidity.

Figure 6:
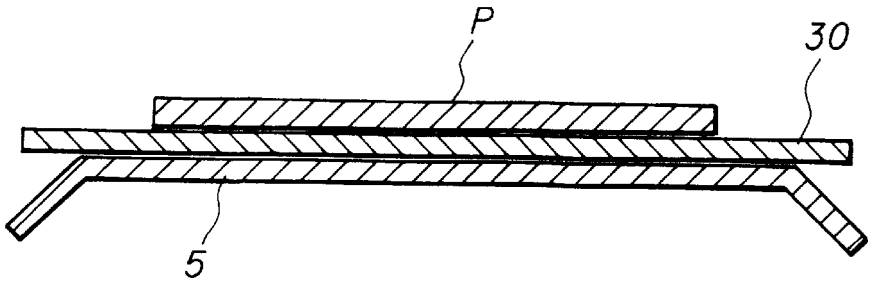
FIG. 6 is a sectional view showing the transfer device of FIG. 5, cut by a plane perpendicular to the conveying direction of the paper sheet.

FIG. 6 is a sectional view cut by a plane perpendicular to the conveying direction of the paper sheet P. The sectional view shows the charge erasing electrode plate 5 in contact with the transfer belt 30 and the paper sheet P during charge erasing. In particular, the width of the charge erasing electrode plate 5 is smaller than that of the transfer belt 30 and is greater than that of the maximum size of the paper sheet P. This arrangement makes it possible to efficiently remove the static charge from, at least the area in which the paper sheet P and the transfer belt 30 statically attract one another.

In FIG. 5, the driven roller 34 as the exit-side roller is not connected to the ground, but in order to further weaken the electrostatically attracting force of the paper sheet P, if the roller 34 is connected to the ground, the effect of erasing charges can further be enhanced. In addition, it is also possible to promote the separating tendency of the sheet P attributed to the rigidity of the sheet if the curvature of the driven roller 34 is made large.

Figure 7:
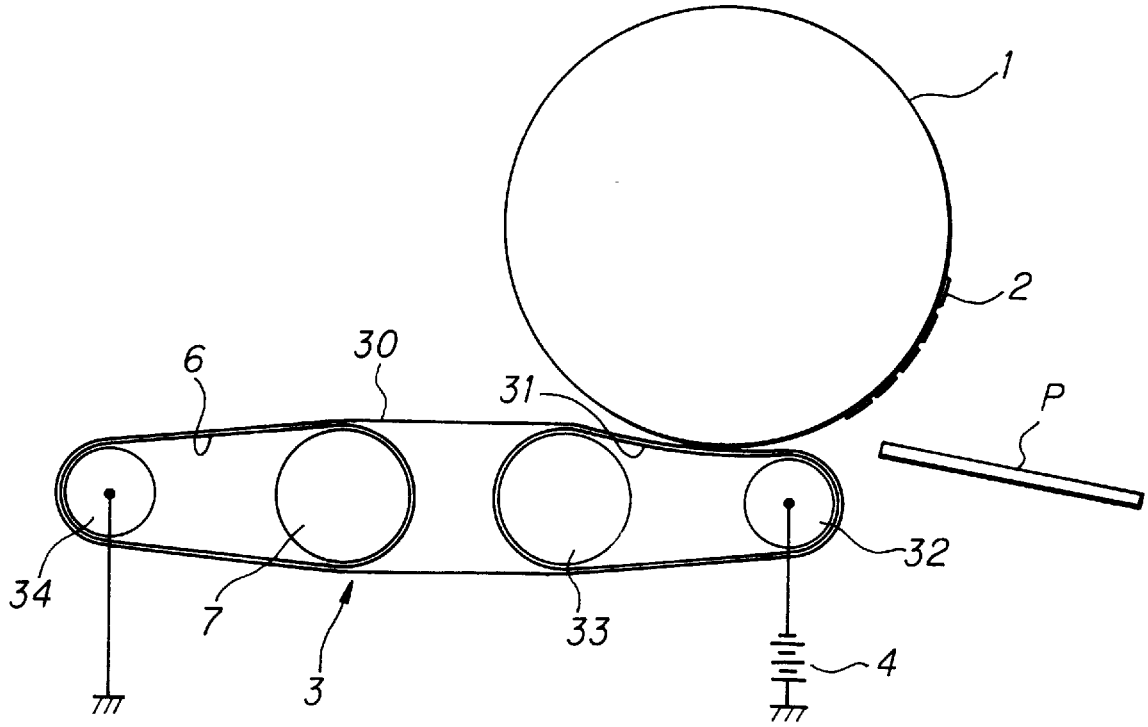
FIG. 7 is a front view showing a variational example of the transfer device in accordance with the second embodiment of the invention.

FIG. 7 shows a variation in which a conductive belt 6 is provided inside the transfer belt 30 in place of the charge erasing electrode plate 5 of metal etc. This conductive belt 6 is made from a metal etc., with a very small volume resistivity. This belt 6 is tensioned between the driven roller 34 as the aforementioned exit-side roller and another driven roller 7 as another exit-side roller which is disposed between the driving roller 33 and the driven roller (the exit-side roller) 34. That is, in the embodiment shown in FIG. 7, a plurality of exit-side rollers 34 and 7 are provided and the conducive belt 6 is stretched between these rollers so that the belt 6 will be in contact with the inner side of the transfer belt 30. In this case, in order to establish an intimate contact with the transfer belt 30, the diameter of the driven roller 7 is formed equal to or greater than that of the driving roller 33. Besides, the driven roller 34 and/or driven roller 7 are connected to the ground. Since the conducive belt 6 will not impart the frictional resistance to the transfer belt 30, the transfer belt 30 will smoothly be rotated or transported in synchronism with the conductive belt 6.

Because of the arrangement as above, the static charge accumulated on both the paper sheet P and the transfer belt 30 within the range where the conductive belt 6 and transfer belt 30 are in contact with each other, will flow to the ground contact of the driven roller (the exit-side roller) 34 via the conductive belt 6, whereby it is possible to realizably eliminate the static charge. Accordingly, the potentials of the paper sheet P and the transfer belt 30 lower, and therefore the statically attracting force is weakened.

Since, in the example shown in FIG. 7, the contact area of the inside surface of the transfer belt 30 is considerably greater than that of FIG. 5, the effect of erasing charges can be improved. Therefore, the effect of weakening the statistically attracting force between paper sheet P and transfer belt 30 can be further improved. That is, when the transfer belt 30 turns in the reverse direction along the circumferential side of the driven roller 34, this decrease of the attracting force with the help of the rigidity of the paper sheet P itself, enhances the separating performance of the paper sheet P from the transfer belt 30.

Similarly to the voltage supplying belt 31 of FIG. 3, the width of the conductive belt 6 is smaller than that of the transfer belt 30 and is set greater than that of the maximum size of the paper sheet P used. By this method, it is possible to efficiently remove the static charge from, at least the area in which the paper sheet P and the transfer belt 30 statically attract one another.

(Other embodiments)

Still another embodiment of the invention will be described hereinbelow. In the above second embodiment, the description was made of a method of effectively separating the paper sheet P after transfer, from the transfer belt 30. Now, a method with which the paper sheet P is reliably conveyed to the separating position by utilizing the conveying capacity of the transfer belt 30 is described hereinbelow. That is, instead of limiting the contact range between the voltage supplying belt 31 and the transfer belt 30 in FIG. 2 to the transfer area, the voltage supplying belt 31 is provided so as to come in close contact with, for example, the entire part of the transfer belt 30. By this arrangement, the paper sheet P, after the completion of transfer, can surely be conveyed while the paper is maintained to be statically attracted to the transfer belt 30.

Figure 8:
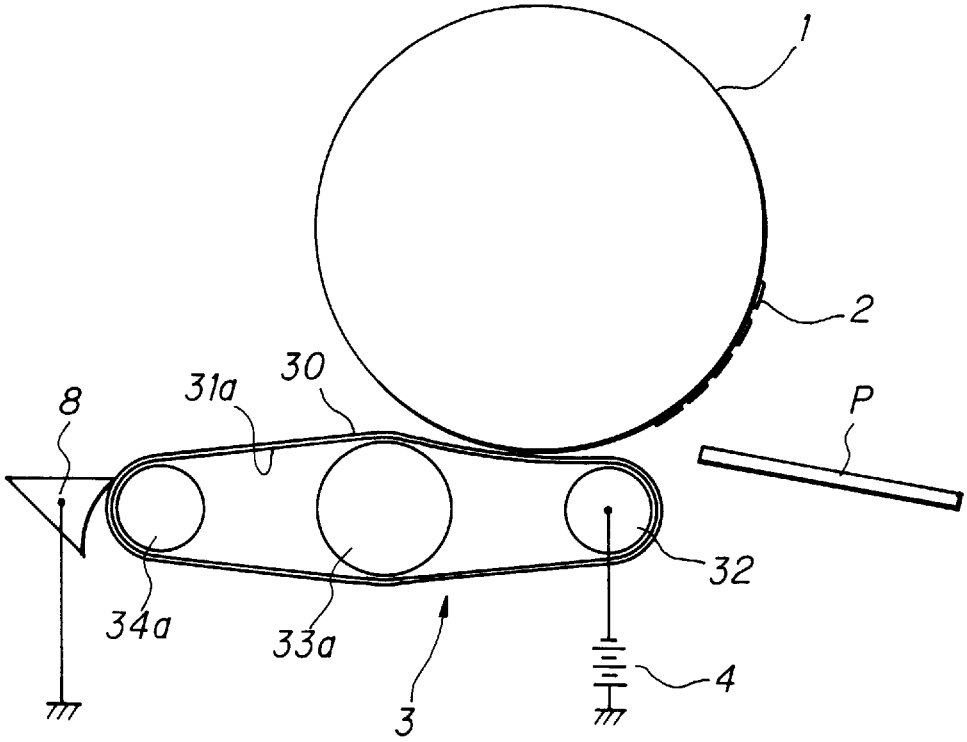
FIG. 8 is a front view showing an example of a transfer device for illustrating the other embodiment of the invention.

FIG. 8 shows an example of it. As stated above, the difference from FIG. 2 resides in that a voltage supplying belt 31*a* is placed correspondingly to the entire inside surface of the transfer belt 30. A second roller 33*a* disposed in the middle is not a driving roller but a driven roller. An exit-side roller 34a disposed on the leftmost side in the figure is a driving roller.

The position of the driving roller (as the exit-side roller) 34*a* corresponds to the separating point of the paper sheet P. Provided around the rotating portion of the driving roller 34*a* are separating claws 8 for separating the paper sheet P from the transfer belt 30. The separating claw 8 is provided pivotable and is urged in the clockwise direction in the figure, by an unillustrated urging means such as a spring etc., so that one end of the claw is abutted against the transfer belt 30 with an appropriate pressing force. The separating claw 8 is connected to the ground.

In this arrangement, the first roller or driven roller 32 is applied with the voltage from the power source 4 so that the voltage is supplied to the transfer belt 30 via the conductive belt 31*a*. In this case, toner image 2 formed on the photoreceptor 1 is statically transferred to the paper sheet P within the transfer area of the transfer belt 30, as illustrated FIG. 2.

The part of the transfer belt 30 after the completion of the transfer operation is still supplied with the voltage via the conducive belt 31*a* even after the passage of the large-diametric second roller or driven roller 33*a*.

Therefore, the paper sheet P is conveyed whilst it is statically being attracted to the transfer belt 30.

Then, the paper sheet P which has sufficiently been attracted electrostatically by the transfer belt 30 is sent to the position where the exit-side roller or driving roller 34*a* is, where the sheet is forcibly peeled off from the transfer belt 30 by means of the separating claws 8. Since the underside of the thus separated paper sheet P will contact with parts of the separating claws 8 which are connected to the ground, the static charge on the paper sheet P can be eliminated as it passes by the position of the separating claws 8. The contact end of the separating claw 8 which meets the transfer belt 30 is insulated so as not to eliminate the charge on the transfer belt 30. This ensures that the transfer belt 30 is able to efficiently achieve the conveyance and transfer operations of the next paper sheet P.

Figure 9:
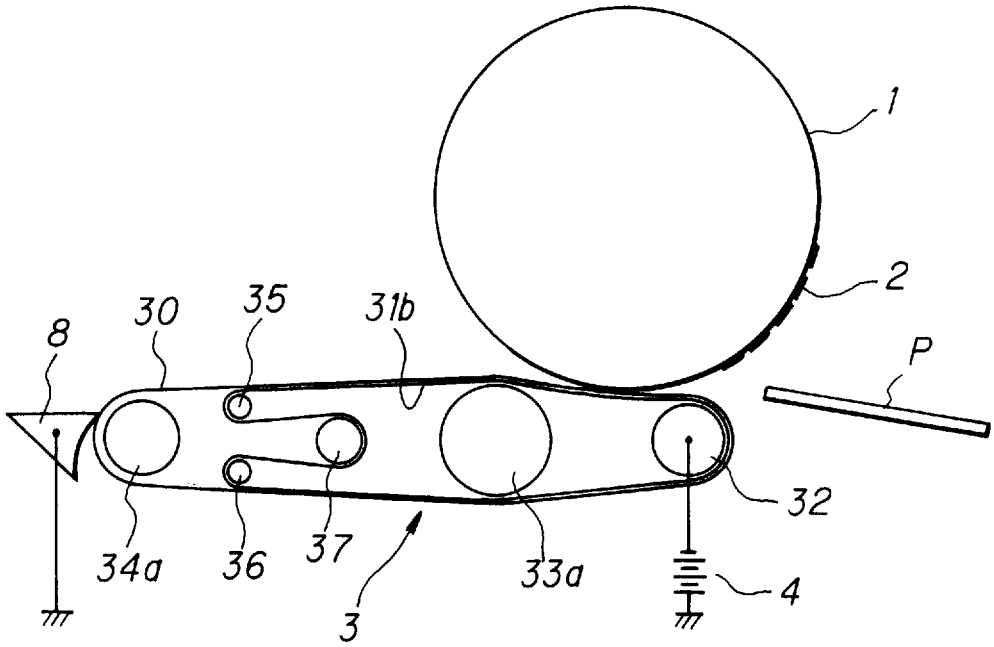
FIG. 9 is a front view showing a variational example of the transfer device in accordance with the other embodiment of the invention.

Instead of providing the voltage supplying belt 31*a* which is placed correspondingly to the entire inside surface of the transfer belt 30 as shown in FIG. 8, FIG. 9 shows a variational arrangement in which a voltage supplying belt 31*b* is arranged in a winding manner so that the belt 31*b* will not be in contact with the transfer belt 30, at least in the separating region in the vicinity of the exit-side roller or driving roller 34*a*. This arrangement also enables the transfer belt 30 to electrostatically attract the paper sheet P after transfer, thus making sure the reliable conveyance of the paper sheet P.

As seen in FIG. 9, a plurality of small-diametric driven rollers 35, 36 and 37 are provided as exit-side rollers. In order for the voltage supplying belt 31*b* not to touch the inside surface of the transfer belt 30 in the position of the exit-side roller or driving roller 34*a*, the voltage supplying belt 31*b* is wound between these small-diametric rollers and the first roller or driven roller 32 with the second large diametric-driven roller 33*a* in between. This voltage supplying belt 31*b* is also made from the same material as used for the voltage supplying belt 31 illustrated in FIG. 2, and is supplied with the voltage from the power supply 4 via the first roller or driven roller 32.

Then, as illustrated in FIG. 2, the paper sheet P is fed into the transfer area where the paper is charged by the voltage induced on the transfer belt 30 whereby the toner image 2 is transferred to the paper. The paper sheet P, after the completion of the transfer operation, is reliably conveyed within the region where the voltage supplying belt 31*b* and transfer belt 30 are in contact with one another, without the electrostatically attracting force between the paper and the transfer belt 30 being weakened.

Subsequently, when the paper sheet P is conveyed up to the exit-side position where the driving roller 34*a* is, the paper sheet P is going to peel off by its own rigidity at the turning point of the driving roller 34*a*. In this position, the voltage supply to the transfer belt 30 is undone so as to reduce the electrostatically attracting force between the paper sheet P and the transfer belt 30. In this way, it is possible to readily separate the paper sheet P from the transfer belt 30 with the function of separating claws 8 which are disposed opposite to the roller 34*a* that is closest to the exit with respect to the sheet conveying direction.

In this case, the transfer belt 30 will not attract the paper sheet P more during the separation of the sheet P than that in the case of FIG. 8, thus the paper sheet will not need a large separating force exerted by the separating claws 8. As a result, there is no fear that the sheet itself would be damaged by the claws, whereby it is possible to readily separate the paper sheet P.

In accordance with the transfer device of the invention, since a greater transfer area can be ensured, it is possible to readily improve the transfer efficiency. Accordingly, it is possible to assure an adequate time for transfer and therefore obtain a sufficient transfer efficiency without needing the voltage for transfer to be increased. Thus, it is possible to make the apparatus deal with the high-speed image forming.

Since the transfer device itself is able to convey the sheet whilst directly separating the sheet after transfer, from the recording medium, the apparatus does not need any special separating means for separating the sheet from the recording medium while the sheet can be conveyed directly to the next stage after the completion of the transfer operation. Consequently, the image forming apparatus can be downsized.

Further, in the separating stage after the conveyance of the sheet by the transfer device, it is possible to readily separate the paper by weakening the electrostatically attracting force between the sheet and transfer device. In consequence, it is possible to separate the paper without any special separating means.

What is claimed is:

1. An image transfer device comprising:

a pair of rollers including a first and second roller, said second roller being disposed downstream of said first roller with respect to the sheet conveying direction;

an endless voltage supplying belt made from a conductive material, and tensioned between said first and second rollers;

an exit-side roller which is positioned downstream of said second roller; and an endless transfer belt tensioned between said first roller and said exit-side roller so that a sheet to be processed may be introduced to a next processing stage, wherein said first and second rollers are appropriately positioned so that the part of said transfer belt between said first and second rollers can be kept in contact with a recording medium, and a predetermined voltage is supplied to the voltage supplying belt via said first and second rollers.

2. An image transfer device according to claim 1 wherein a charge erasing electrode plate which is grounded is abutted against a part of said transfer belt between said second roller and said exit-side roller.

3. An image transfer device according to claim 1 wherein a plurality of exit-side rollers are provided in place of one exit-side roller, and an endless conductive belt which is grounded is tensioned between said exit-side rollers so as to come in contact with the part of the inside surface of said transfer belt between said exit-side rollers.

4. An image transfer device according to claim 1 wherein said conductive belt as the voltage supplying belt is laid out by a plurality of exit-side rollers, in place of one exit-roller, in such a winding manner that said conductive voltage supplying belt will not be in contact with said transfer belt, at least in the separating region in the vicinity of the exit-side rollers, and a sheet-separating claw or claws are arranged opposite to the exit-roller which is closest to the exit side with respect to the sheet conveying direction.

5. An image transfer device comprising:

a plurality of rollers;

a first belt defining an endless transfer belt tensioned between two of said plurality of rollers so as to be abutted against a recording medium forming a transfer portion, so that an image formed on the recording medium is transferred to a sheet of paper in the transfer portion; and a second belt, separate from the first belt, defining an endless voltage supplying belt made from a conductive material, and tensioned inside said transfer belt, between one of said two rollers and another roller located between said two rollers, wherein said two rollers are appropriately positioned so that said tensioned transfer belt can be kept in contact with the recording medium, and a predetermined voltage is supplied to the voltage supplying belt.

* * * * *